US012595578B1

(12) United States Patent
Holland

(10) Patent No.: US 12,595,578 B1
(45) Date of Patent: Apr. 7, 2026

(54) PRODUCTION OF METALS FROM METAL OXIDES

(71) Applicant: Consolidated Nuclear Security, LLC, Oak Ridge, TN (US)

(72) Inventor: Justin M. Holland, Clinton, TN (US)

(73) Assignee: Consolidated Nuclear Security, LLC, Oak Ridge, TN (US)

( * ) Notice: Subject to any disclaimer, the term of this patent is extended or adjusted under 35 U.S.C. 154(b) by 687 days.

(21) Appl. No.: 17/808,219

(22) Filed: Jun. 22, 2022

(51) Int. Cl.
*C25C 7/06* (2006.01)
*C25C 3/34* (2006.01)
*C25C 7/02* (2006.01)

(52) U.S. Cl.
CPC ..... *C25C 7/06* (2013.01); *C25C 3/34* (2013.01); *C25C 7/025* (2013.01)

(58) Field of Classification Search
CPC ..... C25C 3/34; C25C 7/005
See application file for complete search history.

(56) References Cited

U.S. PATENT DOCUMENTS 4,297,174 A 10/1981 Brambilla et al.
4,578,242 A 3/1986 Sharma
4,680,055 A 7/1987 Sharma
4,880,506 A * 11/1989 Ackerman ..... C25C 3/34 205/47
H857 H 12/1990 Haas
5,118,396 A * 6/1992 Claus ..... C25C 3/34 205/363
5,164,050 A 11/1992 Bertaud et al.
5,421,855 A 6/1995 Hayden, Jr. et al.
5,932,084 A * 8/1999 Takamaru ..... C25C 3/34 210/602
8,221,609 B2 7/2012 Fujita et al.
9,249,520 B2 2/2016 Withers et al.
9,410,227 B2 8/2016 Boudreault et al.
(Continued)

FOREIGN PATENT DOCUMENTS

CN 103725897 B 3/2016

OTHER PUBLICATIONS

Cohen, W; Zhou, W.; Wu, E.;Zhang, J., "Molten Fluoride Salt and Liquid Metal Multistage Extraction Model," 2017, pp. 1-18, Ohio State University, Ohio.

(Continued)

*Primary Examiner* — Ciel P Contreras
(74) *Attorney, Agent, or Firm* — Luedeka Neely, P.C.

(57) ABSTRACT

A process and apparatus for producing a metal (RE) from a metal oxide (REOx). The method includes introducing the REOx and a reductant into a molten alkali and/or alkaline earth metal chloride salt phase in an oxide reductant compartment (ORC) of a partitioned process vessel. A tray containing the REOx in the ORC is reciprocated in contact with the salt phase and a molten metal collection pool phase below the salt phase. Metal formed by the reductant is induced to move through the molten metal collection pool phase from the ORC to a recovery and purification compartment (RPC) on an opposite side of a partition of the process vessel. A mixture of alkali and/or alkaline earth chloride salt containing from about 1 to about 10 wt. % chloride salt of the metal (RE) being produced is electrolyzed in the RPC. Metal produced on a cathode in the RPC is recovered.

9 Claims, 2 Drawing Sheets

(56) References Cited

U.S. PATENT DOCUMENTS

| | | | | |
|---|---|---|---|---|
| 9,945,009 | B2 | 4/2018 | Boudreault et al. | |
| 10,309,022 | B2 | 6/2019 | Awazu et al. | |
| 2005/0072271 | A1 | 4/2005 | Kim et al. | |
| 2012/0156492 | A1* | 6/2012 | Dudley | C25C 3/28 205/560 |
| 2014/0191382 | A1* | 7/2014 | Asami | H05K 3/3485 257/676 |
| 2014/0291161 | A1* | 10/2014 | Awazu | C22C 1/02 205/348 |
| 2015/0129432 | A1* | 5/2015 | Wright | C25C 3/26 205/741 |
| 2024/0191382 | A1* | 6/2024 | Zhao | C25C 7/00 |

OTHER PUBLICATIONS

Gupta, C. K.; Krishnamurthy, N., "Extractive Metallurgy of Rare Earths," Intl. Matl. Rev. (1992), vol. 37(5); pp. 197-248.

Rema Abdulaziz, "Electrochemical Reduction of Metal Oxides in Molten Salts for Nuclear Reprocessing," 2016, pp. 1-193, University College London, England.

Sharma, R. A.; Seefurth, R.N., "A Molten Salt Process for Producing Neodymium and Neodymium-Iron Alloys," Metallurg. Trans. B, (1989), vol. 20B, pp. 805-813.

* cited by examiner

PRODUCTION OF METALS FROM METAL OXIDES

GOVERNMENT RIGHTS

The U.S. Government has rights to this invention pursuant to contract number DE-NA0001942 between the U.S. Department of Energy and Consolidated Nuclear Security, LLC.

TECHNICAL FIELD

The disclosure is directed to the production of metals from metal oxides and in particular to a partitioned process apparatus and method for producing metals from metal oxides in the partitioned process apparatus.

BACKGROUND AND SUMMARY

There is a growing market for the production and use of rare-earth elements for applications such as permanent magnets in computer hard drives, cell phones, electric motors for hybrid vehicles, windmills, actuators in aircraft, among other applications. Rare earth elements are also used for military defense and security for the manufacture of precision guided munitions, lasers, radar, sonar, communications, displays, jet engines, etc. The rare earth metals (e.g., La, Nd, Eu, Er, etc.) are used extensively by many industries to make specialty alloys, magnets, ceramics and semiconductors.

The production of pure metals (RE) from their oxides (REOx) can be challenging, especially in the case where the metal being produced is one of the rare earth or actinide elements, due to the high thermodynamic stability of the oxide forms of the foregoing elements. The rare earth and actinide elements cannot be easily produced in metallic form since the metal oxides are not amenable to chemical reduction by hydrogen or carbon. Given that rare earth and actinide elements are found almost entirely in various oxide forms in the earth's crust, much effort has been devoted to the development of processes which liberate the metal from the oxide.

The most widely used method for producing rare earth metals from their oxides at the present time is electrolysis of molten fluoride salts in which the oxides are dissolved. While this method is characterized by high efficiency (>85%), its primary disadvantages are high operating temperatures (1000 to 1700° C.) and production of $CO_2$, which is a greenhouse gas. In addition, for applications where metal purity is a concern, the electrolysis method may not be suitable as purities can range from 85-99.9% depending on the metal being produced and the particular system configuration.

Another method that is used to produce rare earth and actinide metals is metallothermic reduction. Several variations of this method have been described in the literature, many of which propose a process for first producing a metal halide from a rare earth or actinide oxide followed by chemical reduction using calcium, magnesium and/or lithium metal. The rare earth or actinide metal is recovered after the reduction by distillation of the residual salt and high temperature melting to form a consolidated ingot. The metallothermic reduction method can produce metal at high yields (~99%) and reasonable purities (>99.5%). The main disadvantages of the metallothermic method are need for specialized equipment and the use of hazardous reactants required to produce the metal chloride.

A more direct approach to producing rare earth and actinide metals that has been considered is to reduce the metal oxide directly with chemical reductants. The direct chemical reductant method typically requires a molten salt flux to dissolve the oxide that is produced when the metal oxide is reduced by the reductant (e.g. Li Ca, or Na which form $Li_2O$, CaO and $Na_2O$, respectively). One such method uses a sodium or calcium metal reductant, a $CaCl_2$—KCl—NaCl melt and a liquid Nd—Fe pool to convert $Nd_2O_3$ to Nd. The reaction occurs in the molten salt phase, which contains $Nd_2O_3$ particles suspended by vigorous stirring and dissolved reductant Na or Ca metal. The metallic Nd formed by the reaction is dissolved into the molten Nd—Fe pool while the $Na_2O$ or CaO byproduct is dissolved into a molten salt flux. The process reportedly produces high yields (>95%) of Nd metal in the form of a Nd—Fe alloy with metal purities as high as 99.5%. Despite the foregoing, there remains a need for a safer and more efficient process for the production of rare earth and actinide metals in high purities from oxides of the metals.

In view of the foregoing, there is provided an apparatus and a process for producing a metal (RE) from a metal oxide (REOx). The process includes introducing a metal oxide (REOx) and a reductant into a molten alkali and/or alkaline earth metal chloride salt phase in an oxide reductant compartment (ORC) of a partitioned process vessel. A tray containing the metal oxide (REOx) is reciprocated in the ORC in contact with the salt phase and a molten metal collection pool phase below the salt phase. Metal (RE) formed by the reductant is induced to move through the molten metal collection pool phase in the ORC to a recovery and purification compartment (RPC) on an opposite side of a partition of the partitioned process vessel. A mixture of an alkali and/or alkaline earth chloride salt containing from about 1 to about 10 wt. % chloride salt of the metal (RE) being produced is electrolyzed in the RPC in an electrolytic phase. The metal (RE) being produced on a cathode inserted into the mixture in the RPC is recovered from the cathode.

In another embodiments, there is provided a partitioned process vessel for recovering metal (RE) from a metal oxide (REOx). The partitioned process vessel includes an oxide reductant compartment (ORC), a recovery and purification compartment (RPC), and a molten metal collection pool phase spanning the ORC and RPC. A partition wall isolates the ORC from the RPC and extends into the molten metal collection pool phase. A reductant metal input tube is provided for introducing a reductant metal into the ORC. A second input tube is provided for introducing the metal oxide (REOx) and an alkali and/or alkaline earth metal chloride salt into the ORC. A perforated tray is disposed in the ORC for reciprocating the metal oxide (REOx) through a molten alkali and/or alkaline earth metal chloride salt phase and into the molten metal collection pool phase to deposit metal (RE) therein as a metal alloy. A cathode in the RPC is provided for electrolyzing an electrolytic phase and for oxidizing the metal alloy in the molten metal collection pool phase.

Another embodiment of the disclosure provides a process for producing a metal (RE) from a metal oxide (REOx). The process includes providing a partitioned vessel having an oxide reductant compartment (ORC), a recovery and purification compartment (RPC), and a molten metal collection pool phase spanning the ORC and RPC. The partitioned vessel has a partition wall that isolates the ORC from the RPC and extends into the molten metal collection pool phase. The metal oxide (REOx) is introduced into a perforated tantalum or molybdenum tray disposed in a molten alkali and/or alkaline earth metal chloride salt phase in the ORC. An amount of metal reductant selected from the group consisting of calcium, sodium and potassium is dissolved in the molten alkali and alkaline earth metal chloride salt phase in the ORC above the molten metal collection pool phase. The amount metal reductant is an amount sufficient to reduce all of the metal oxide (REOx) to metal (RE) that is then dissolved in the molten metal collection pool phase in the ORC. The tantalum or molybdenum tray is reciprocated in the salt phase and the metal collection pool phase. The metal (RE) is transported by forced convection through the molten metal collection pool phase from the ORC to the RPC. In the RPC a mixture of an alkali and/or alkaline earth chloride salt containing from about 1 to about 10 wt. % chloride salt of the metal (RE) being produced is electrolyzed in an electrolytic phase in contact with the molten metal collection pool. The metal RE) being produced on a cathode inserted in the mixture in the RPC is recovered from the cathode.

In some embodiments, the molten metal collection pool phase includes a molten metal having a higher specific gravity than the alkali and/or alkaline earth metal chloride salt phase. In other embodiments, the molten metal collection pool phase comprises a metal selected from iron, zinc, aluminum, and other non-rare earth metals.

In some embodiments, the metal (RE) is a metal selected from rare earth metals and actinides.

In some embodiments, the reductant is calcium.

In some embodiments the partitioned process vessel is purged with an inert gas.

In some embodiments, the process further includes removing the recovered metal (RE) from the cathode and consolidating the metal (RE) into a metal ingot.

In some embodiments, the metal (RE) is a rare earth metal selected from lanthanum, cerium, praseodymium, and neodymium.

In some embodiments, the partitioned process vessel is contained within an insulated and heated containment vessel. In other embodiments, an inert gas purge system is provided for the insulated and heated containment vessel.

In some embodiments, the perforated tray is a tray made from tantalum or molybdenum.

In some embodiments, an induction coil is provided for inducing movement of metal alloy from the ORC to the RPC through the molten metal collection pool phase.

In some embodiments, the cathode includes a metal rod attached to a flat disc, wherein the metal rod is inserted into a ceramic portion having an opening therein and a porous ceramic frit covers the opening in the ceramic portion.

An advantage of the foregoing process and apparatus is that a high purity metal can be made and recovered on a continuous or semi-continuous basis at relatively low temperatures without the generation of hazardous or greenhouse gases such as $CO_2$. Another advantage is that the process can be conducted in a single process vessel using a combination of metal oxide reduction and electrolysis without the need for a separate process vessel or metal formation step. Electrolysis confers additional purification to the metal (RE) and it is expected that metal purity exceeding 99.99% may be obtained from the process.

DETAILED DESCRIPTION

Figure 1:
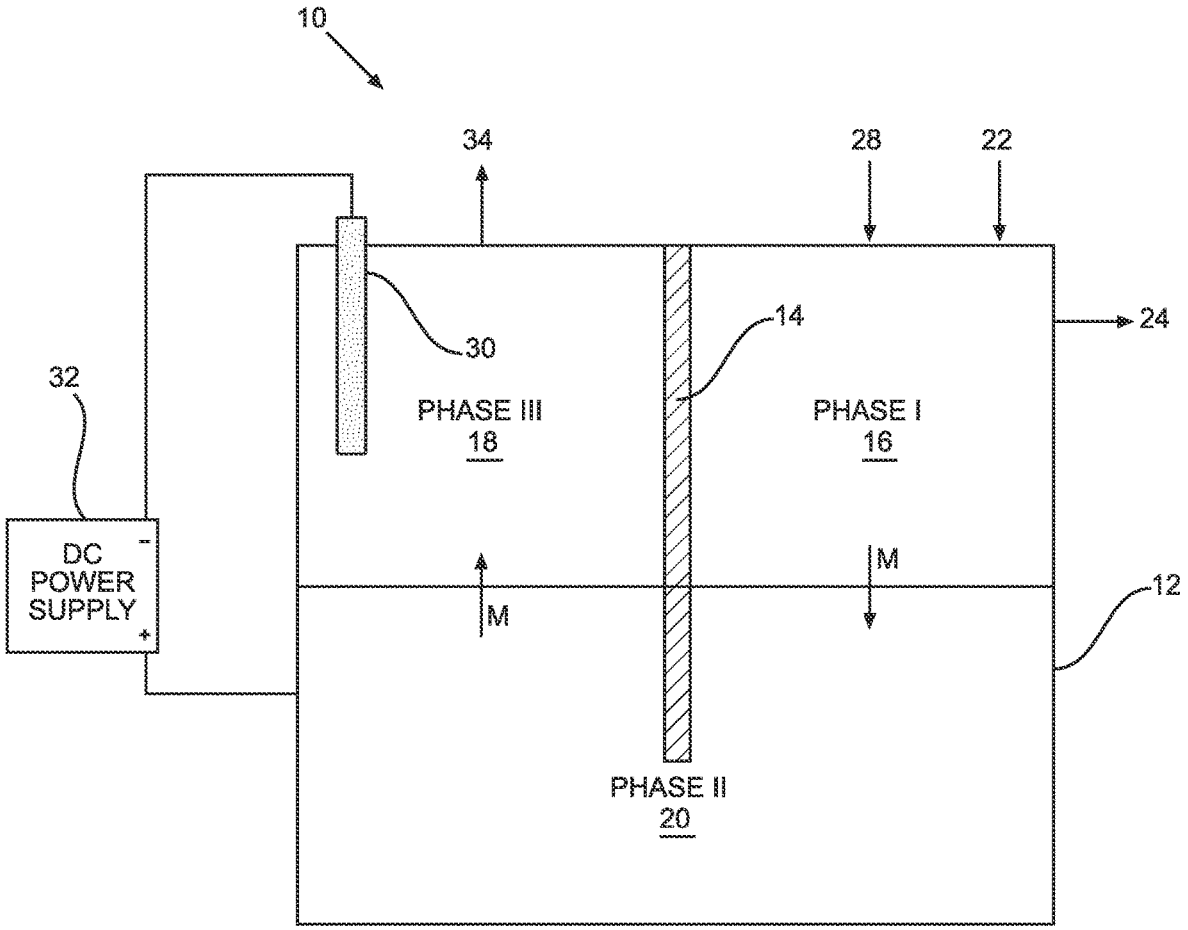
FIG. 1 is a schematic illustration of the overall process and apparatus.

With reference to FIG. 1, there is illustrated an apparatus 10 for producing metal from a metal oxide. A key feature of the apparatus 10 is a process vessel 12 having a partition wall 14 therein for isolating a Phase I compartment 16 of the vessel 12 from a Phase III compartment 18 of the vessel 12. The partition wall 14 extends into a molten metal in a Phase II compartment 20 that is in chemical contact with the Phase I compartment 16 and the Phase III compartment 18 of the vessel 12.

During the production of metal (RE) from a metal oxide (REOx) the Phase I compartment 16 is provided with a molten alkali and/or alkaline earth metal chloride salt that is maintained at a constant level in the Phase I compartment 16 by a salt make up port 22 and an overflow port 24. A metal oxide (REOx) is introduced into the Phase I compartment 16 also through salt make up port 22 and a reductant is introduced to the Phase I compartment 16 through in reductant port 28.

Metal (RE) produced by the reductant is combined with the molten metal in the Phase II compartment 20 to form a metal alloy. The metal alloy is in contact with the Phase III compartment 18 containing a mixture of an alkali and/or alkaline earth chloride salt containing from about 1 to about 10 wt. % chloride salt of the metal (RE) and a cathode assembly 30 for electrolytic extraction of the metal (RE) from the metal alloy in the Phase II compartment 20. Metal (RE) from the Phase I compartment 16 is transported through the molten metal alloy in the Phase II compartment 20 to the Phase III compartment 18. A DC power source 32 provides power to the cathode assembly 30 for collecting dendrites of the metal (RE) on a cathode of the cathode assembly 30. Purified metal 34 is recovered from the cathode and may be formed into metal ingots.

Figure 2:
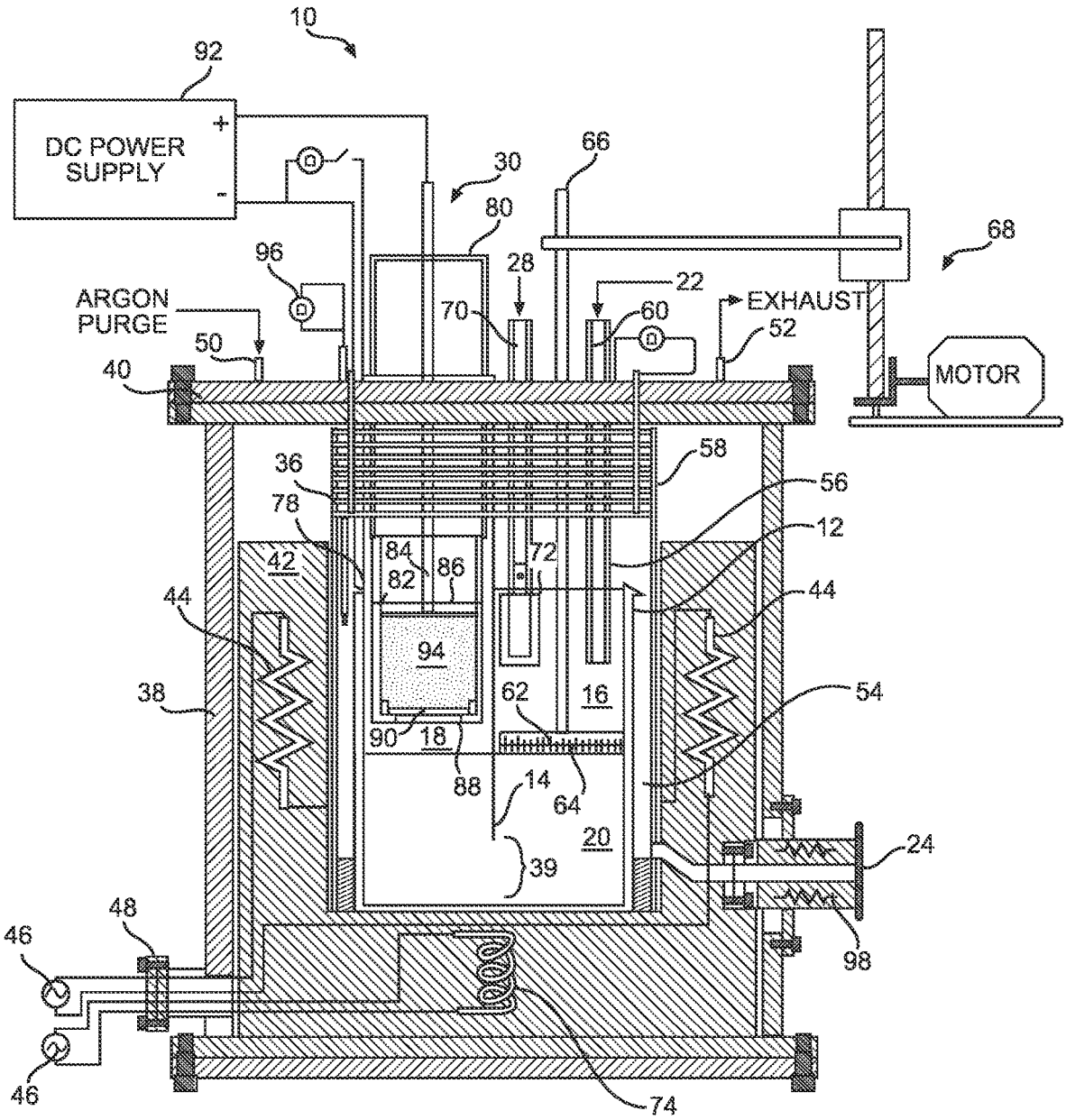
FIG. 2 is a cross-sectional view, not to scale, of a containment vessel containing a partitioned process vessel for producing metals from metal oxides.

FIG. 2 is a cross-sectional view of a cylindrical process vessel 12 that is contained within a secondary process vessel 36. Both the process vessel 12 and the secondary process vessel 36 are enclosed in a containment vessel 38. The process vessel 12 is fabricated from tantalum, molybdenum, tungsten or alloys thereof in order to withstand the processing temperature and contact by the process fluids. The process vessel 12 contains a partition wall 14, made of the same metal(s), which is welded to the inner walls of the process vessel 12. The partition wall 14 is positioned in the process vessel 12 so that a gap of is left open at the bottom of the process vessel 12. The gap 39 may range from a few inches to a few feet depending on the size of the process vessel 12. The partition wall 14 continues beyond a top opening of the process vessel 12 and expands to meet an inner wall of the secondary process vessel 26. The partition wall 14 helps to ensure that vapors produced on either side of the partition wall 14 do not cross over to the side thereof.

The Phase II compartment 20 of the process vessel 12 is filled with a liquid metal-iron (M-Fc) metal-zinc (M-Zn) pool that extends past the bottom of the partition wall 14. The height of the M-Fe pool past the bottom of the partition wall 14 is not critical, provided the height is sufficient to provide two isolated compartments 16 and 18 on either side of the partition wall 14 which share contact with the M-Fe pool in the Phase II compartment 20. In some embodiments, the molten metal iron or zinc pool is provided by a near cutectic allow of the metal (RE) with iron or zinc.

The containment vessel 38 is fabricated from structural steel that is capable of withstanding elevated processing temperatures. The containment vessel 38 is configured to be air-tight to prevent the release of vapors or hazardous gases from the process to the atmosphere. A removable, gasketed top flange 40 is provided for the containment vessel 38 to enable access to the process vessel 12 and secondary process vessel 36 contained therein. The gasket material used for the top flange 40 may be selected from polymeric or metallic materials, depending upon the expected process temperatures that are used. Fibrous ceramic insulation 42 containing embedded electrical resistance heating elements 44 is located inside the containment vessel 38. The embedded electrical resistance heaters act as the primary source of thermal energy for heating and maintaining process fluids used in the process at the desired operating temperature. AC electrical power 46 required for the heating elements can be routed into the containment vessel 38 via a flanged port 48 located on a side of the containment vessel 38. The top flange 40 of containment vessel 38 is equipped with ports 50 and 52 for the use of an inert gas purge, if needed, to provide a pristine gas cover over the process.

During the process, reduction of a metal oxide (REOx) occurs in the Phase I compartment 16. The Phase I compartment 16 of the process vessel 12 is referred to as the oxide reduction compartment (ORC). The Phase I compartment 16 contains the molten alkali and/or alkaline earth chloride salt, or mixtures thereof and is filled to a level where it begins to overflow into an annular space 54 provided between the process vessel 12 and the secondary process vessel 36. The proper fill level for the Phase I compartment 16 may be determined by measuring an electrical resistant between a metal wire probe 56 that is positioned at a desired fill level height and a heat shield assembly 58 that makes electrical contact with the molten salt via the partition wall 14. Make up salt can be added to the Phase I compartment 16 using a ceramic tube (e.g., MgO) 60 that is compatible with the molten salt at the process operating temperature. The metal oxide (REOx) particles 62 may also be added to the Phase I compartment 16 through the ceramic tube 60. The metal oxide (REOx) particles 62 are caused to fall into a perforated tantalum or molybdenum tray 64 that is attached to a solid rod 66 of the same material which extends vertically out of the top flange 40 of the containment vessel 38. A mechanical seal (not shown) may be provided where the solid rod 66 extends through the top flange 40 in order to seal the contents of the containment vessel 38 from the atmosphere.

The solid rod 66 is attached to a reciprocating device 68 that is capable of translating the tantalum tray 64 vertically in both the up and down directions. The range of motion of the tantalum tray 64 in the vertical direction should be such that it traverses through portions of both the molten alkali and/or alkaline earth chloride salt and liquid M-Fe pool. In some embodiments, the tantalum tray 64 is reciprocated at a frequency and speed that provides adequate mixing of the molten alkali and/or alkaline earth chloride salt in the Phase I compartment 16 and contact between the M-Fe pool in the Phase II compartment 20 and the metal oxide particles 62 contained in the tantalum tray 64.

A reductant for reducing the metal oxide (REOx) in the Phase I compartment 16 may be selected from calcium, sodium, potassium, or lithium. A particularly useful reductant is calcium, sodium, or lithium metal which may be added to the Phase I compartment 16 via a ceramic (e.g., MgO) or graphite tube 70 that is optionally fitted with a porous or perforated tantalum frit 72. The frit 72 minimizes the transport of reductant into the Phase I compartment 16 while still allowing the reductant to dissolve into the molten alkali and/or alkaline earth chloride salt so that the reductant can react with the metal oxide (REOx) according to the following reaction:

$$RE_nO_m + mCa \rightarrow mCaO + nRE,$$

wherein n and m are the number of moles of the constituents, where the relation of n and m is determined by the oxidation state of the metal oxide, and where the reductant is calcium.

The metal (RE) formed in the tantalum tray 64 in the Phase I compartment 16 is dissolved into the liquid M-Fe pool in the Phase II compartment 20 and transported through the pool to the Phase III compartment 18 on the left side of the partition wall 14. The Phase III compartment 18 is referred to as a Recovery and Purification Compartment (RPC). The transport rate of the metal (RE) through the pool can be accelerated by forced convection from a low-power induction coil 74 that is optionally placed directly below the secondary process vessel 36. The power source 76 driving the coil can be low voltage AC power source 76 located outside of the containment vessel 38. The Phase III compartment 18 is filled with an alkali and/or alkaline earth chloride salt, or mixtures thereof, containing about 1-10 wt. % of the chloride salt of the metal (RE) being produced. The salt is filled up to a level determined by the position of a metal wire electrode 78 that is attached to an ohmmeter which measures the resistance between the metal wire electrode 78 and the process vessel 12. The position of the metal wire electrode 78 should be selected carefully to compensate for additional displacement that occurs in the Phase III compartment 18 when adding a cathode assembly 30 to the Phase III compartment 18. The cathode assembly 30 consists of a metal frame upper-portion 80 connected to a lower-portion 82 that is made out of a ceramic material (e.g., Al2O3, SiO2) that is compatible with the molten salt in the Phase III compartment 18 at the process temperature. The cathode that is inserted into the lower-portion 82 includes a solid metal rod 84 that is attached to a flat disc 86.

The bottom surface of the ceramic lower-portion 82 has an opening 88 over which a porous ceramic frit 90. The opening 88 and ceramic frit 90 allow electrolyte to flow into the lower portion 82 of the cathode assembly 30 while minimizing inefficiency caused by the metal (RE) that is deposited on the flat disc 86 falling back into the liquid M-Fe pool. The material of construction of the cathode assembly 30 should be chosen so that it is compatible with the salt at the process temperature and tends to possess minimal miscibility with the metal RE being deposited thereon.

Electrolysis is initiated by coupling the cathode assembly 30 and the process vessel 12 as an anode to a DC power supply 92 and applying a voltage of 0.1-2 V. The metal (RE) in the M-Fe pool is oxidized and dissolved as a chloride salt due to the DC current and is simultaneously deposited as metal dendrites 94 on the flat disc 86.

After sufficient charge has been passed through the materials in the Phase III compartment 18, the lower portion 82 of the cathode assembly 30 will be filled with metal dendrites 94 and the electrolysis can be momentarily discontinued to remove the cathode assembly 30 and replace the cathode assembly 30 with a new one. The cathode assembly 30 containing the metal dendrites 94 can then be disassembled to recover the metal dendrites 94. Excess salt adhering to the metal dendrites 94 can be removed by vacuum distillation at sufficiently high temperature or by washing with a solvent such as water and/or ethanol. The metal dendrites 94 can then be consolidated into ingot form, producing high purity (>99.99%) consolidated metal (RE).

During the reduction step of the process, alkali or alkaline earth metal oxide accumulates in the molten salt in the Phase I compartment 16, necessitating the replenishment of the molten salt mixture with fresh salt. The removal of old salt is accomplished by adding new salt which increases the salt level and causes overflow into the annular space 54 between the process vessel 12 and the secondary process vessel 36. The secondary process vessel 36 can be equipped with a level sensor 96 which measures the resistance between two metal wire electrodes separated by a ceramic dielectric. After the sensor has detected that the salt level in the annular space 54 has reached a trigger height, the salt can be drained from the system by actuating a valve located on the overflow port 24 that extends from the secondary process vessel 36 through the containment vessel 38. The overflow port may be surrounded by insulation and/or resistance heating elements 98 to ensure that the salt remains molten as it drains from the system 10.

The following non-limiting example is provided to illustrate aspects of the disclosed embodiments. In this example, RE=Nd, the phase I chloride salt is LiCl, lithium metal is added to the phase I compartment through the reductant port 28. The metal oxide is Nd2O3 which is added to the Phase I compartment through the salt make up port 22. In order to maintain the level of reactants in the Phase I compartment, LiCl containing dissolved $Li_2O$ is removed through the overflow port 24. The Phase II compartment contains molten an Fe—Nd eutectic pool containing about 78 atomic percent Nd. The Phase III compartment contains LiCl containing about 3 to about 5 wt. % dissolved NdCl3. The temperature of the Phase I, Phase II and Phase III compartments is maintained at about 700 to about 750° C. DC power is applied to the cathode assembly 30 and process vessel 12 by the DC power suppl at about 0.5 to about 0.7 volts to cause the Nd in the molten Fe—Nd eutectic pool to form dendrites of Nd on the cathode assembly 30.

The rate of Nd metal production is determined by the current that flows through the DC power supply 32 at the operating voltage. The current will depend primarily on the rate of transport of Nd from the Phase I compartment to the Phase II compartment, which in turn is dependent upon the reaction rate of Li and Nd2O3 in the Phase I compartment and the dissolution of Nd from the Phase I compartment into the Phase II compartment. Agitation of the Phase I and Phase II compartments by reciprocating the tantalum tray 64 along with the electromagnetic stirring caused by the induction coil 74 will help to maximize the reaction and dissolution rates.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A process for producing a metal from a metal oxide comprising:

introducing a metal oxide selected from rare earth metal oxides and actinide oxides, and a reductant into a molten alkali and/or alkaline earth metal chloride salt phase in an oxide reductant compartment (ORC) of a partitioned process vessel;

reciprocating a tray containing the metal oxide in the ORC in contact with the salt phase and a molten metal collection pool phase below the salt phase, wherein the molten metal collection pool comprises a metal selected from the group consisting of iron, zinc, aluminum, and other non-rare earth metals;

inducing metal selected from rare earth metals and actinides formed by the reductant to move through the molten metal collection pool phase in the ORC to a recovery and purification compartment (RPC) on an opposite side of a partition of the partitioned process vessel;

electrolyzing in the RPC a mixture of an alkali and/or alkaline earth chloride salt containing from 1 to about 10 wt. % chloride salt of the metal being produced in an electrolytic phase in the RPC; and recovering the metal being produced on a cathode inserted into the mixture in the RPC, wherein the entire process for producing the metal from the metal oxide is conducted at a temperature ranging from about 700° C. to about 750° C.

2. The process of claim 1, wherein the reductant comprises calcium.

3. The process of claim 1, further comprising purging the partitioned vessel with an inert gas.

4. The process of claim 1, further comprising removing the recovered metal from the cathode and consolidating the metal into a metal ingot.

5. The process of claim 1, wherein the metal is a rare earth metal selected from the group consisting of lanthanum, cerium, praseodymium, and neodymium.

6. A process for producing a metal from a metal oxide comprising:

providing a partitioned vessel having an oxide reductant compartment (ORC), a recovery and purification compartment (RPC), and a molten metal collection pool phase spanning the ORC and RPC, wherein the partitioned vessel comprises a partition wall that isolates the ORC from the RPC and extends into the molten metal collection pool phase;

introducing the metal oxide selected from rare earth metal oxides and actinide oxides into a perforated tantalum or molybdenum tray disposed in a molten alkali and/or alkaline earth metal chloride salt phase in the ORC;

dissolving an amount of metal reductant selected from the group consisting of calcium, sodium and potassium in the molten alkali and alkaline earth metal chloride salt phase in the ORC above the molten metal collection pool phase, wherein the molten metal collection pool comprises a metal selected from the group consisting of iron, zinc, aluminum, and other non-rare earth metals, wherein the amount metal reductant is an amount sufficient to reduce all of the metal oxide to metal selected from rare earth metals and actinides that is dissolved in the molten metal collection pool phase in the ORC;

reciprocating the tantalum or molybdenum tray in the salt phase and the metal collection pool phase;

transporting the metal by forced convection through the molten metal collection pool phase from the ORC to the RPC;

electrolyzing in the RPC a mixture of an alkali and/or alkaline earth chloride salt containing from 1 to about 10 wt. % chloride salt of the metal being produced in an electrolytic phase in contact with the molten metal collection pool; and recovering the metal being produced on a cathode inserted in the mixture in the RPC, wherein the entire process for producing the metal from the metal oxide is conducted at a temperature ranging from about 700° C. to about 750° C.

7. The process of claim 6, wherein the partitioned process vessel is contained within an insulated and heated containment vessel, further comprising purging the containment vessel with an inert gas during the dissolving and electrolyzing steps.

8. The process of claim 6, further comprising forming dendrites of the metal on the cathode.

9. The process of claim 8, wherein the metal is a rare earth metal selected from the group consisting of lanthanum, cerium, praseodymium, and neodymium.

* * * * *